United States Patent [19]

Olsen

[11] Patent Number: 4,864,949

[45] Date of Patent: Sep. 12, 1989

[54] FLUID FOIL SYSTEM

[76] Inventor: Eric Olsen, Box 578, Marion, Mass. 02738

[21] Appl. No.: 144,657

[22] Filed: Jan. 12, 1988

Related U.S. Application Data

[63] Continuation of Ser. No. 266,884, May 26, 1981, abandoned.

[51] Int. Cl.[4] ..... B63H 9/08

[52] U.S. Cl. ..... 114/39.1; 114/39.2; 114/98; 114/102

[58] Field of Search ..... 244/38, 46, 47; 114/39, 114/102, 103, 89, 90, 91, 95, 96, 97, 98, 39.1, 39.2

[56] References Cited

U.S. PATENT DOCUMENTS 4,382,417 5/1983 Talve ..... 114/39.2

*Primary Examiner*—Sherman D. Basinger
*Assistant Examiner*—Thomas J. Brahan
*Attorney, Agent, or Firm*—Robert J. Doherty

[57] ABSTRACT

An improved fluid foil system which is particularly adapted yet not limited to use in sail craft. When used in e.g. a sailboat, the foil is rotationally supported with respect to a mast and laterally tiltable about a longitudinal axis in either direction to receive the wind which in turn powers the boat on which the mast is supported. The mast can be supported in the boat at the other end thereof so as to enable free rotation with respect thereto. In addition, the system is provided with self-leveling means for the foil so as to continually urge such to its rest or non-tilted position, that is, in a position generally parallel to the water, i.e., at a zero attack angle with respect to the wind. This combination of a self-leveling, tiltable, and freely rotationable foil enables the foil to be securely attached to the mast with a minimum of structural weight. This in turn enables both simplified and improved control of the foil and the boat which it powers and otherwise enables maximization of both light and heavy winds in a herethereto unachieved manner.

18 Claims, 5 Drawing Sheets

FLUID FOIL SYSTEM

This application is a continuation of Ser. No. 266,884 filed May 26, 1981 now abandoned.

BACKGROUND AND OBJECTS OF THE INVENTION

This invention relates to an improved foil system which is capable of receiving energy from the flow of a fluid medium and efficiently transferring a portion of such energy to the structure on which such foil system is supported. More particularly, the invention is directed to an improved sail system for sailboats and the like, although it should be pointed out that the invention is not so limited but has utility to efficiently extract or divert dynamic forces generated from fluid flow conditions regardless of the medium of such fluid flow, i.e., whether it be wind, water current, etc. Other applications of the device other than operating a sail craft include power generation, irrigation, littoral deposits, agricultural anti-frost and drying air movement. However, inasmuch as the use of the improved fluid foil system of the present invention in connection with a sail craft is an easily understood and recognized example, it will be used hereinafter as the means by which the present invention will be described.

In the art of sail craft, constant effort through the years has been utilized to decrease the difficulties of accommodating varied wind strengths and to increase the freedom to maneuver sail craft despite wind direction and strength. Effort has also been made and continues towards extracting wind power and water power especially at low flow rates while retaining the ability to accommodate substantially higher velocities thereof.

Various attempts have also been made to utilize foils ranging from airplane wings to sail simulations of ancient Samoan craft, tilted to either side of a mast or the like in changing tacks and seeking an increasing stability by varying the lateral tilt angle so as to control the above indicated parameters. Each said system however introduces unmanageable difficult mechanical complications such as heavy structural stresses and large control forces as well as introducing unreasonably complicated manipulation or timing mechanisms in order to control such foils.

Some attempts to utilize tiltable foils in connection with sail craft include U.S. Pat. No. 2,170,914 to Rummler issued Aug. 29, 1939 which, although generally indicative of rigging concepts in this area, fails to present structural, aerodynamic or operational solutions of a feasible commercial nature. Other patents include U.S. Pat. No. 2,319,999 to Jennings issued May 25, 1943 directed to a wing flap control; U.S. Pat. No. 1,670,936 issued May 22, 1928 to McIntyre et al; U.S. Pat. No. 2,126,665 to Rowland issued Aug. 9, 1938 and directed to a complex system of multiple booms pivoting on the hull for sail support and operation; U.S. Pat. No. 2,387,907 to Hook issued Oct. 30, 1945 which includes a sail foil which can vary its lateral attitude; U.S. Pat. No. 4,177,345 issued Mar. 7, 1978 to Gurley directed to a sail supported by two spars directly mounted on a revolving mount located proximate to the hull and controlled through torsional means working on its shaft; U.S. Pat. No. 3,858,542 issued Jan. 7, 1975 to Lenoble directed to a hand supported foil; U.S. Pat. No. 3,924,870 issued Dec. 9, 1975 to Spivak et al and also directed to hand supported sail; U.S. Pat. No. 3,455,261 issued Jul. 15, 1969 to Perrin also directed to a foil structure having particular utility for a sail board; U.S. Pat. No. 2,329,220 issued Jul. 12, 1939 to Rummler directed to a variable spread sail/spar structure which is cumbersome and limiting, that is, utilizes a 45° pivot in order to alternate the two sail support spars in horizontal and vertical positioning depending on which tack the vessel is on and thus causes the air flow to essentially flow normal to the vertical spar and parallel to the other; U.S. Pat. No. 2,106,432 issued Jan. 28, 1938 to McIntyre which is directed to a multi-hull craft, the hulls of which can be skewed relative to one another so as to align the wind loads on its two inclined sails relative to its two inclined centerboards. The above recitation and discussion of these patents and other prior structures constitutes applicant's Prior Art Statement; and in that regard, a copy of each such patent is enclosed herewith.

It also may be apparent from the above discussion that the underlying objectives of the present invention are not accomplished by presently available devices in the intended manner. Accordingly, a basic object of the present invention is to provide an improved fluid foil system which can be used to extract or divert substantial dynamic forces generated from fluid flow conditions in such a manner that such foil can be controlled adequately and simply by extremely light and straightforward structural means which can be provided at a reasonable cost.

An additional object of the present invention is the provision of a fluid foil system which operates in a greatly simplified manner and which, accordingly, reduces the learning effort and experience which an operator must acquire to operate the system and yet which has wide adaptability and usefulness when applied to water sail craft such as sailboats.

A further object of the present invention is the provision of an improved fluid foil system which can be used in fixed location power generating systems which is effective in very light winds or in slow water currents as well as in fluids of higher velocity and when assuming different flow directions.

These and other objects of the present invention are accomplished by a fluid foil system for imparting energy from a moving fluid medium to a supporting body, said system including a fluid foil connected to a mast along a longitudinal axis thereof, said foil supported for multi-rotational movement with respect to said body, said foil further adapted for lateral tilt in either direction with respect to said mast about said longitudinal axis from a rest or "level" position where said foil is free to be aligned with the directional flow of said fluid medium to a tilted position wherein said fluid imparts energy to said foil, and self-leveling means for said foil connected to both said foil and said mast and adapted to urge said foil to said rest position.

Other objects, features and advantages of the invention shall become apparent as the description thereof proceeds when considered in connection with the accompanying illustrative drawings.

DESCRIPTION OF THE INVENTION

Figure 1:
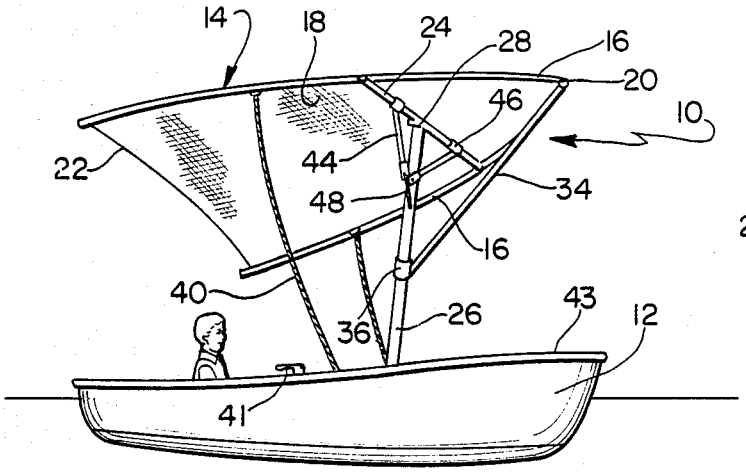
FIG. 1 is a perspective view showing the fluid foil system of the present invention utilized in conjunction with a boat to power the same and depicted in its rest position with respect to wind currents generally assumed to be parallel to the surface of the water.
Figure 2:
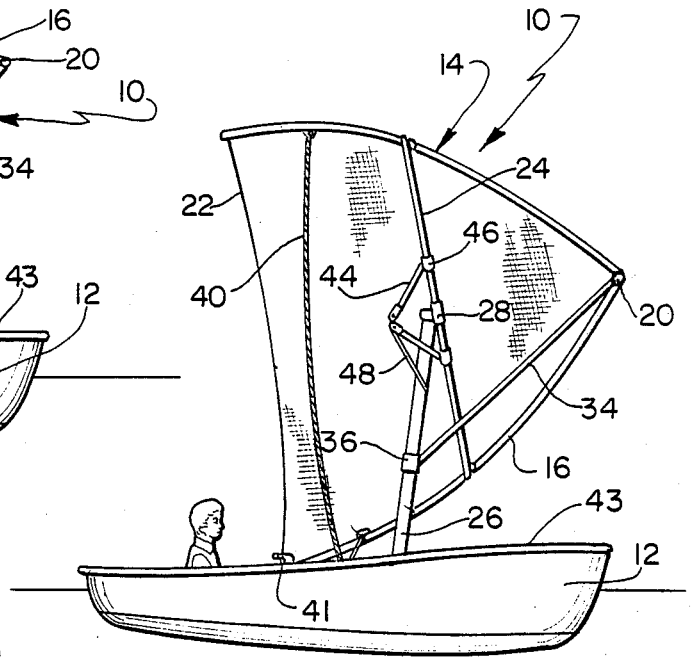
FIG. 2 is a view similar to FIG. 1 but showing the foil in a tilted position into the wind.
Figure 3:
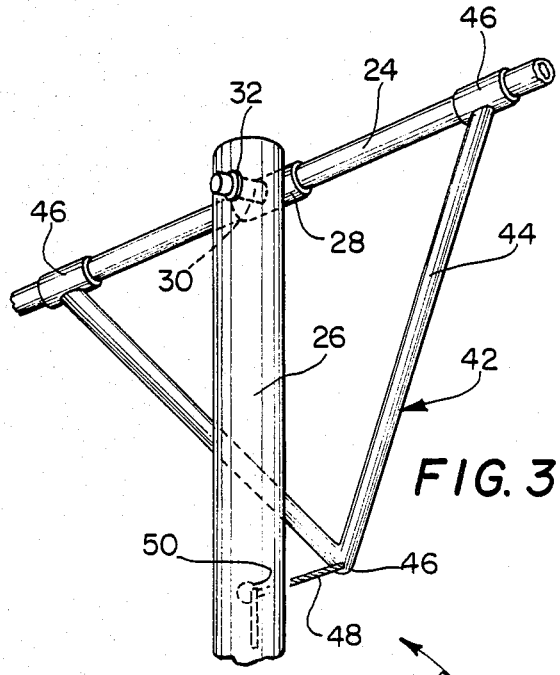
FIG. 3 is a perspective view showing a manner in which the foil may be torsionally connected to the mast.

Turning now to the drawings and particularly FIG. 1 thereof, the improved fluid foil system 10 of the present invention is depicted as part of a sailboat construction including a hull 12 of any suitable construction. The foil system 10 includes a foil 14 including a pair of flexible A-frame spars 16 which serve to stretch a deltaform sail 18 therebetween. The foil 14 may be otherwise constructed including formation from rigid sheet material and the like. The foil 14, accordingly, exhibits a nose portion 20 and a trailing edge 22. A cross bar 24 extending between the spars 16 serves to stretch the sail 18 and maintain it in such condition.

Figure 4:
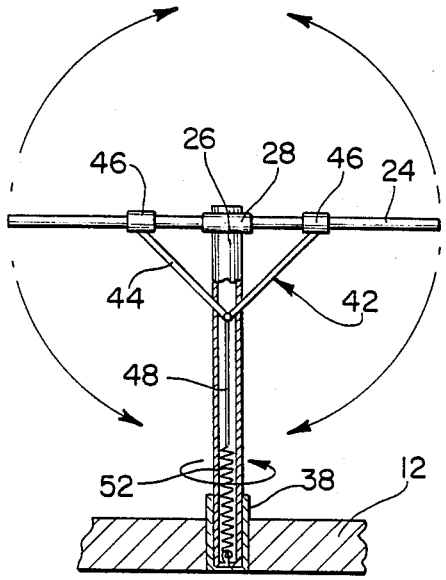
FIG. 4 is a somewhat schematic elevational view showing the attitudes of tilt which the foil may take with respect to the mast as well as the manner in which the mast may rotate with respect to the boat.
Figure 5:
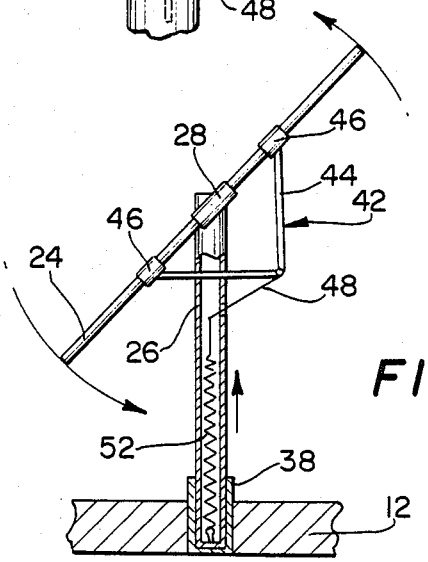
FIG. 5 is a view similar to FIG. 4 but showing a particular manner in which the self-leveling means for the foil operates.
Figure 6:
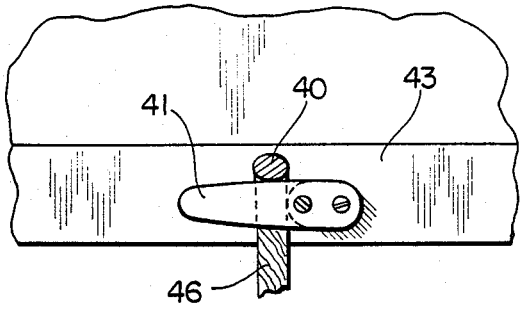
FIG. 6 is a partial plan view of a means for controlling the attitude of the foil including a sheet or line attached thereto and a fairlead mounted on the upper rail of the boat.
Figure 7:
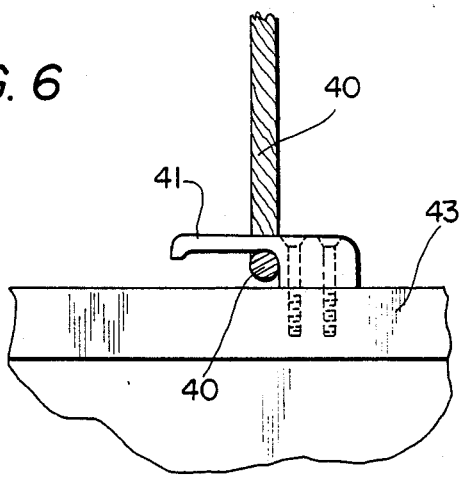
FIG. 7 is a partial elevational view of the fairlead shown in FIG. 6.

The foil 14 is torsionally mounted to a mast 26 generally along its longitudinal axis of lateral symetry such that the foil 14 may assume various positions of lateral tilt with respect to the mast as shown by the arrows in FIGS. 4 and 5. Such connection is accomplished by means of a sleeve 28 fixed in position to the cross bar 24 at its midpoint and from which a pin 30 rearwardly extends through the hollow interior of the mast 26. A connector 32 of any suitable construction such as the screw cap shown serves to fasten the pin 30 on the other side of the mast 26 such that the cross bar 24 and, accordingly, the foil 14 is free to assume the lateral tilt in either direction as above-described. It will be apparent in this construction that the lateral aerodynamic lift forces are largely counterbalanced about the flexible mast mount which in this case is a pivotal connection. Accordingly, the foil 14, when otherwise unconstrained, is free to seek a luffing attitude of pitch where the angle of attack of the foil 14 in regard to the wind forces (assumed to be generally parallel to the surface of the water on which the sailboat is supported) essentially neutralizes the lift forces of such fluid medium against the foil.

A strut 34 is attached to a collar 36 so as to enable pivotal motion in a vertical plane of such strut. The collar 36 is in turn adjustably fixedly connected to the mast 26 at one end and extends upwardly to the nose 20 of the foil 14 at its other end. Accordingly, this strut 34 extending between the leading nose 20 of the foil 14 serves to position the pitch of the foil's longitudinal axis. Normally such pitch is set such that the foil assumes a horizontal, i.e., position parallel to the water, such that foil has a neutral lift when disposed in its normal luffing or level attitude as shown in FIG. 1.

The mast 26 is supported by being appropriately "stepped" in the hull 12 and is free for multi-rotational movement with regard thereto. Thus, the mast 26 has a rotational degree of freedom greater than 360° with respect to the hull 12 in either direction. It thus may be seen that the combination of the ability of the mast to rotate in the above-indicated manner with the ability of the foil 14 to tilt about the mast in either lateral direction enables the foil 14 to assume a wide range of directional headings and positions vis-a-vis the directional flow of the wind such that the desired degree of its force may be harnessed in any particular case. Also, the torsional link between the foil 14 and mast 26 eliminates any complication or entanglement of these means of attitude positioning and control since they rotate in unison to any directional heading, including multi-rotational weathervaning. Also, the ability of the foil 14 to weathervane as above-described coincidentally places the required portion of its drag towards its trailing edge 22.

The above-described support or connection of the foil 14 to the mast 26 need not however be a direct connection. Thus the foil could be connected to a sleeve or some other member in turn supported by the mast and capable of free or at least multi-rotational movement with respect to the mast. In such case the mast itself would not need to be capable of actual rotation with respect to the boat or other support. Accordingly, the term mast as used herein and including the claims of this application is used in a broad sense which would include such an intermediate member such as a sleeve, etc.; in other words, the mast supports the foil for multi-rotational movement.

In order to control the degree of lateral tilt of the foil 14, a continuous sheet 40 is attached to the spar 16 some distance behind the cross bar 24. The bight or loop of this sheet 40 passes over a fairlead 41 opening to the rear and mounted on opposite sides of a hull rail 43 to the rear of the position of the mast 26 and thence to a retractor (not shown) attached to the mast and elastically drawing the sheet slack to the lower portion of the mast. When the sheet 40 is released from the fairleads, it is able to completely rotate with the foil system 10, that is, with the mast and foil 14 without entangling the crew, passengers, or boat gear. Partial rotation of the mast occurs without entanglement even with the sheet engaging the fairleads.

Also, due primarily to the largely counterbalanced longitudinal pitch forces of aerodynamic lift upon the foil 14, the sheet 40 control forces are minimized. In this regard, it should be pointed out that the aerodynamic lift forces applied to the foil 14 are also generally laterally balanced about its longitudinal axis of lateral symetry because its pivotal mount is centrally located on this axis. The foil may, however, be purposely unbalanced to enable aerodynamic leveling as for instance shown in FIGS. 15–17. Thus balanced, a minimum force is required to mechanically induce a leveling or horizontal-seeking lateral attitude towards which the foil tends to return when otherwise unconstrained, i.e., by the force application to the control sheet 40 in either direction. Force application is accomplished simply by the operator grasping and pulling the appropriate side of the sheet and released by the operator flipping the sheet afterward to clear the sheet from the fairleads 41.

A self-leveling assembly 42 is provided such that the foil when otherwise unconstrained will seek a rest, level, or luffing attitude generally normal to the mast 26 and parallel with the direction of wind force. The term level, leveling, etc. as used herein means in a preselected attitude with respect to the mast which is generally but not necessarily normal thereto. Such leveling system 42 includes a V-shaped yoke 44 attached to opposite sides of the cross bar 24 by means of sleeves 46. The apex 46 of such yoke 42 is attached to a cord 48 extending into the hollow interior of the mast 26 through an opening 50 proximal the yoke apex 46 when the foil 14 is in the normal rest attitude. The cord 48 is connected in turn to a spring 52 mounted in the interior of the mast 26 and, accordingly, the cord 48 serves to place a continual downward and inward force upon the yoke 42. Instead of a separate spring 52, the cord 48 could be an elastic cord commonly referred to as a "shock cord". Also, the term spring encompasses members which apply a spring-like force, e.g., spring reels, cylinders, etc. It may be thus apparent that when the foil 14 assumes a lateral tilt with respect to the mast such as shown in FIG. 5 that the downward force applied thereto by the self-leveling means 42 tends to return the foil to its level or rest position shown in FIG. 4. It should, of course, be brought out that the force of such leveling system is not great enough so as to present difficulty in being overcome by the control sheet 40 but that when the foil is otherwise unconstrained, that is, not being held in a lateral tilt attitude by the control sheet 40, that it will seek its normal lateral or rest disposition automatically. The term "cord" as used above and hereinafter includes flexible tensile members, e.g., flexible joined links, e.g., chain, wire cable, and the like.

Figure 8:
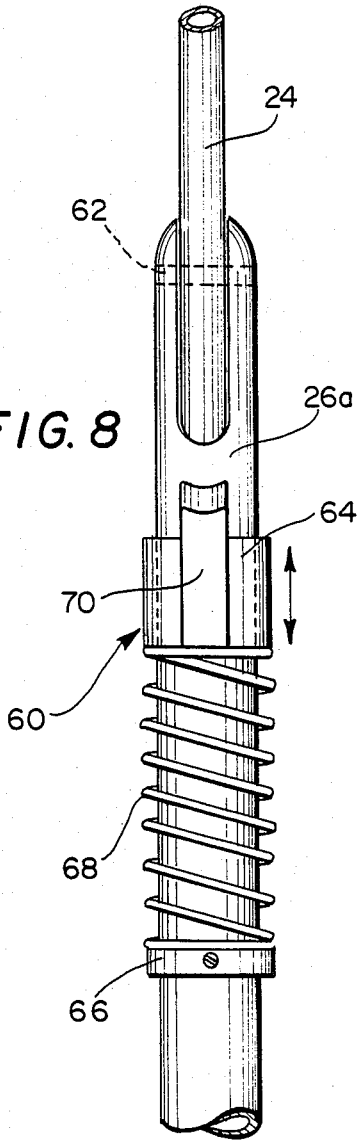
FIG. 8 is an elevational view showing another form of a foil self-leveling means.
Figure 9:
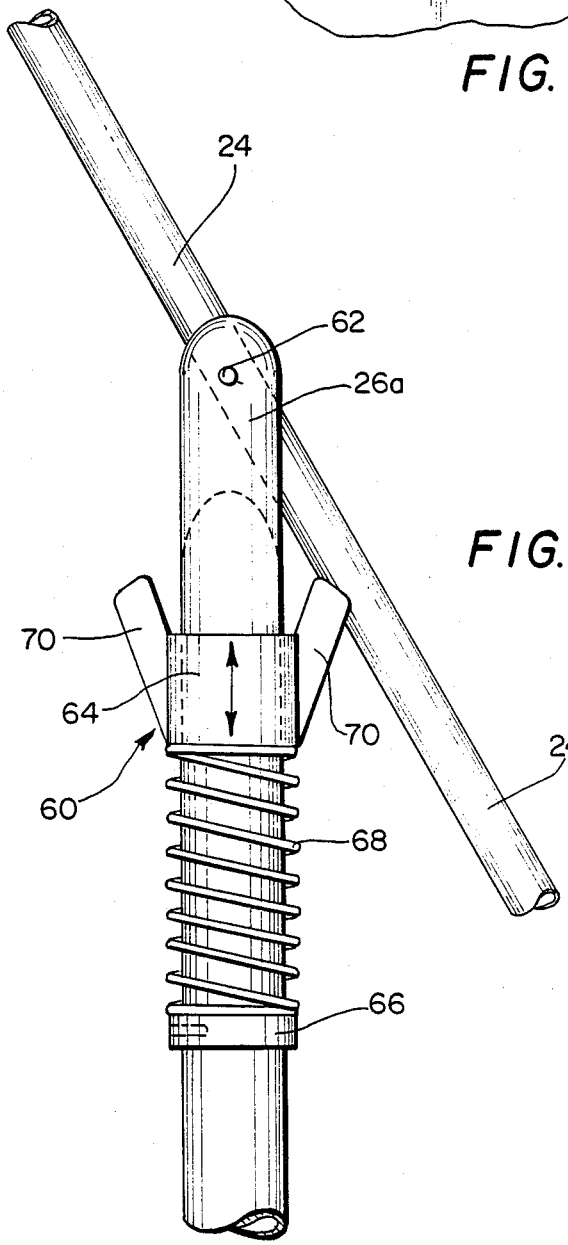
FIG. 9 is an elevational view of the means shown in FIG. 8 but turned 90°.

The self-leveling means may also be integral with the connection of the foil 14 to the mast as by incorporation of a leveling spring therein (see FIG. 20), connected with the foil as described with regard to the system 42 above or separate but in operational contact as with the self-leveling means 60 illustrated in FIGS. 8 and 9. In FIGS. 8 and 9 the cross bar 24 of the foil is pivotally connected to the mast 26 by a pin 62 extending to opposite sides of a bifuracted upper mast terminus A sleeve 64 is adapted for slidable movement of the mast from a point proximate a fixed collar 66 to a point proximate the pivotal connection with the cross bar 24. A compressed coil spring 68 is disposed between the collar and the sleeve so as to continually urge the sleeve upwardly where a pair of arms 70 upwardly outwardly extending from the sleeve 64 are adapted to respectively contact opposite sides of the cross bar 24 dependent on the tilt attitude thereof so as to continually urge such to a level position. As the foil is tilted into the wind by the sheet 40, the sleeve 64 is similarly forced to move downwardly against the action of the spring 68. It should be noted that although self-leveling means 42 as well as self-leveling means 60 have been illustrated as disposed below the position at which the foil is supported by the mast, there is no reason to limit such disposition since the self-leveling means could be positioned above the foil in those cases where the mast projects a suitable distance above the foil connection. In such cases, the self-leveling means 42 would be in effect mounted upside down in the mast projection and the sleeve 64 of the self-leveling means 60 mounted above the cross bar 24. Similar adjustments can be made for other forms of foil leveling and limiting systems that will hereinafter be described.

The manner in which the foil system 10 as above-described in relationship to FIGS. 1 through 5, operates to power the boat 12 will now be described. Since either sailing across the wind or downwind are more easily accomplished than "upwind" or "close hauled" such upwind condition is described. The wind is thus assumed to strike the boat from forward and or one side or the other. To initiate sail propulsion or to get under way when the sail foil 14 is in its weathervaning or level rest position, that portion of the sheet 40 which tilts the foil 14 to leeward of the mast is engaged and trimmed in. The foil, accordingly, both tilts and swings its trailing edge 22 towards the trimming position aft of the mast 26, thus filling away to the wind. The tilt angle is adjustably limited by further control by the operator on the sheet 40 dependent upon wind strength, operator capability, passenger loading or other preference. Tilt may also be adjustably limited by changing the effective length of cord 48.

Once tilted to this selected limit, further trim or easing on the sheet 40 enables the foil system 10 to act entirely as a conventional fore 'n aft sail rig except when the sail is being allowed to luff substantially. Then, it has a slack sheet 40 and will seek its unconstrained rest position automatically. When shifting tacks either by tacking or jibing, the sheet 40 is released and the boat swung through its wind axis. Then the previously unused sheet portion is trimmed as when getting under way. The procedure is simple, and the usual hazard or inconvenience of avoiding unpredictable swinging of a low boom is totally eliminated. There is no severe sail shift or heeling forces or crucial timing necessary during a tack or jibe.

Also, the present foil system provides an inherent mechanism by which the wind force acting upon the foil can be immediately and automatically be shut off regardless of wind orientation as by disengaging the sheet 40 from the fairlead being used and upon which it will assume its rest or luffing position. Such is important especially in mooring or making landings in cramped quarters or in difficult wind circumstances. Thus, the present foil can shut off its sail power in any directional heading and in widely veering winds simply by releasing the sheet so that the foil automatically levels to its weathervane or rest position.

Figure 10:
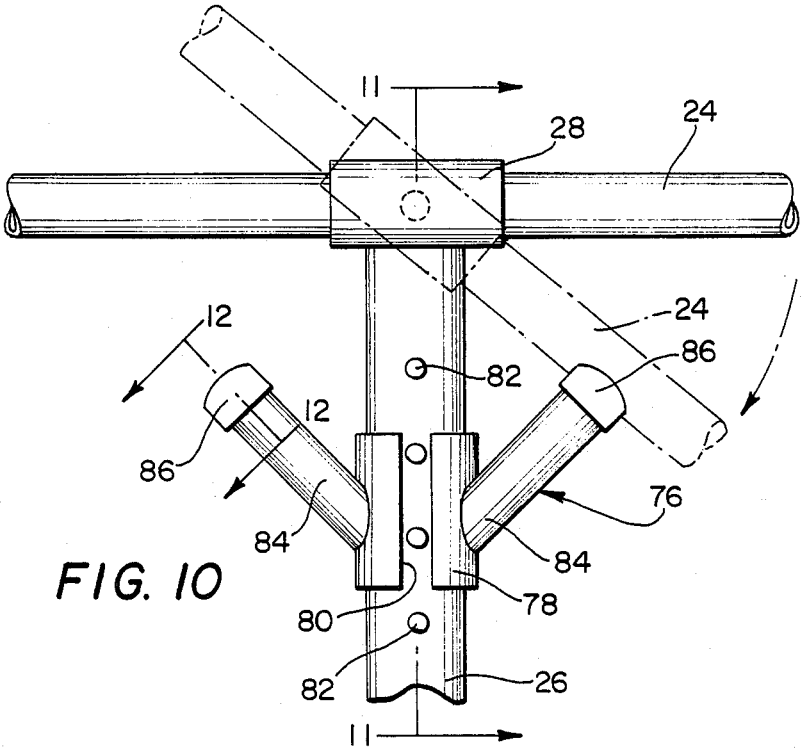
FIG. 10 is an elevational view on an enlarged scale showing a form of tilt limiting means that may be used in conjunction with the fluid foil system of the present invention.
Figure 11:
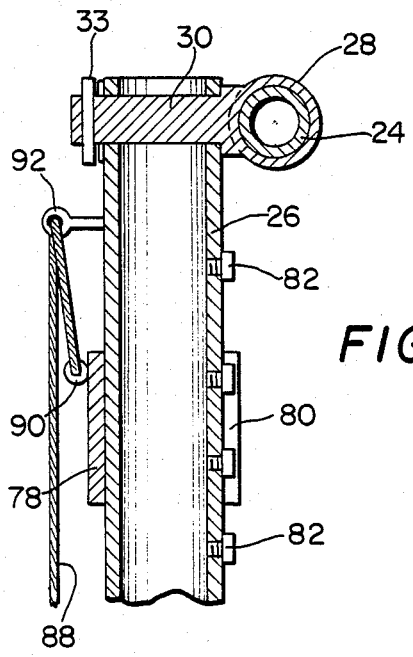
FIG. 11 is a cross-sectional view taken along the line 11—11 of the FIG. 10.
Figure 12:
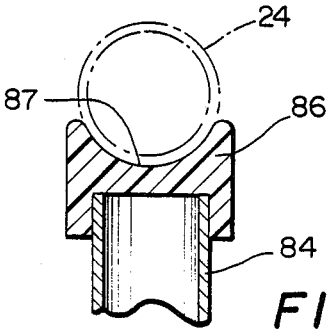
FIG. 12 is a cross-sectional view taken along the line 12—12 of FIG. 10.

In many cases it is desirable to be able to limit in a positive manner the degree of tilt which the foil 12 may assume. Such may be accomplished by a tilt limiting system 76 such as shown in FIGS. 10 through 12 of the drawings. Such system includes a sleeve 78 slidably supported on the mast 26 but fixed in position with respect thereto in a manner which will be hereinafter indicated. The sleeve includes a vertically extending open slot 80 on one side thereof. A series of vertically aligned, spaced bolts outwardly extend from the surface of the mast 26. These bolts 82 are oriented with respect to the slot 80 such that the sleeve 78 may slide up and down on the mast but will not rotate with respect thereto inasmuch as the contact between the heads of the bolts 82 and the opposed edges of the sleeve 78 which form the slot 80 prevents such action.

The sleeve 78 is further provided with a pair of upwardly outwardly extending tubular arms 84, each of which terminates in a headed portion 86. As best shown in FIG. 12, the head 86 which is preferably formed of some shock absorbing material such as a high density foamed polymer includes a concave saddle 87 which is adapted to contact the cross member 24 in such a manner so as to limit its downward tilt, or in those cases wherein the tilt limiting mechanism 76 is mounted on a mast portion extending above the foil—then limiting its upward possible tilt. Thus, it may be seen that by moving the sleeve 78 closer to the pivotal connection between the cross bar 24 and the mast 26 that the resultant degree of tilt of the foil carried by the cross bar 24 may be reduced; and, accordingly, the potential power that may be derived from the wind source limited. Similarly by moving the sleeve downwardly, the potential tilt of the foil may be increased. In this regard, the bolts 82 serve as markers such that the degree of tilt may be readily determined by the position of the sleeve vis-a-vis the bolts 82; and, accordingly, the desired position of the tilt limiting system 76 calibrated according to wind conditions, position of the boat, and experience of its operator. Thus in extremely high winds, it might be desirable to place the tilt limiting mechanism 76 adjacent the uppermost bolt 82, but in light winds such can be placed adjacent the lowermost bolt. The sleeve may be set within the desired predetermined limits by a line 88 which is secured at one end thereof to the sleeve 78 preferably at the rear side thereof, that is, opposite the slot 80 as through an eyelet 90 and thence to a directional change eyelet 92 mounted above the highest desired position of the sleeve and thence downwardly to a conventional attachment point such as a cleat (not shown) mounted on the lower portion of the mast 26. It will thus be seen that as the mast rotates with respect to the boat, that the tubular arms 84 are always aligned in the same plane as the cross bar 24 such that the desired tilt limiting contact is achieved therebetween such as shown by the phantom line representation in FIG. 10 The cross bar 24, is, as in the previous embodiment described in connection with FIGS. 1 through 5, pivotally connected to the mast 26 via a sleeve 28 which in turn includes a rearwardly extending stub 30 which is connected on the other side of the mast by a fastening device such as the lock washer 33 shown.

Generally it is desirable that, as previously indicated, a strut 34 is utilized to adjustably restrict rotation of the cross bar 24 with respect to the sleeve 28 (longitudinal or pitch rotation); however, means such as pins (not shown) may extend through the sleeve into the cross bar to lock the two together and thus prevent this added rotational motion if not desired. When permitting such pitch rotation means such as collars, pins and the like may be used to restrict lateral sliding movement of the cross bar relative to the sleeve. Of course, such lateral sliding motion can be desirable (see, e.g., FIGS. 15–17).

Figure 13:
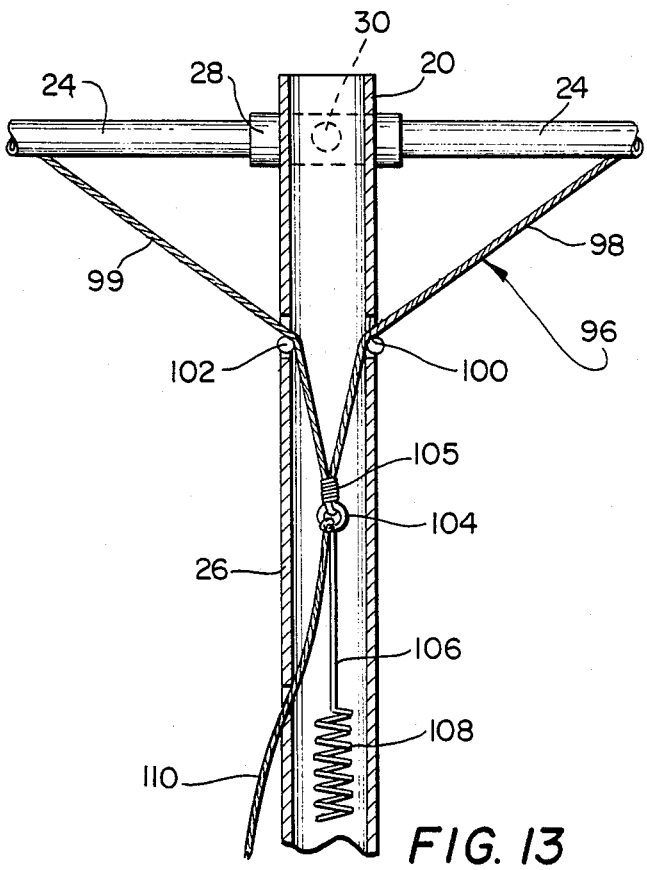
FIG. 13 is partially sectioned elevational view showing another structural form in which the self-leveling means of the present foil system may assume.
Figure 14:
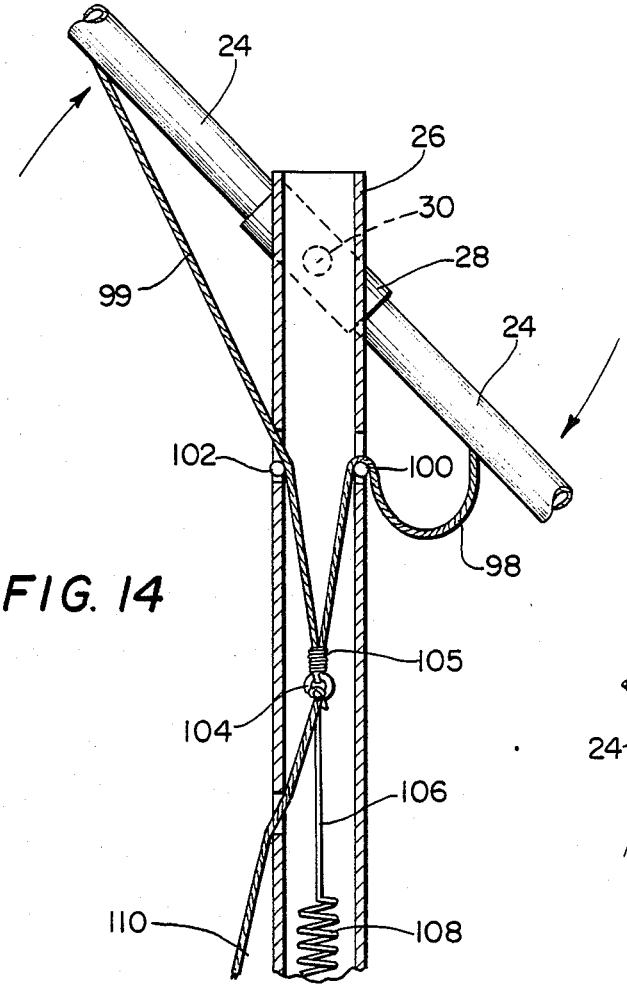
FIG. 14 is a view similar to FIG. 13 but showing the foil in a tilted position.

Turning now to FIGS. 13 and 14 of the drawings, an alternate form of a self-leveling system 96 is depicted. Such system includes lines 98 and 99 connected at opposite free ends thereof to the cross bar 24 at locations outwardly spaced from its pivotal connection with the mast 26. The lines pass through openings 100 provided on opposite sides of the mast 26 and over rollers 102 and thence downwardly to a ring 104 to which the other ends of these lines are attached as by whipping 105. The ring in turn is attached by means of a rod 106 to a spring 108 all internally mounted within the mast 26 so as to place a predetermined amount of downward tension upon the lines 98 and 99 so as to continually urge the cross bar 24 and thus the foil mounted thereon to its rest position in an attitude normal to the mast 26. In such a system when the foil is forced into the wind by manipulation of the control sheet 40 such as depicted in FIG. 14, such causes the line 99 to move upwardly (to the left as shown in FIG. 14) and to cause slack in the right hand line 98. When such control sheet 40 constraint is removed, the predetermined tension supplied by the spring 108 acting upon the line 99 via the rod 106 automatically urges the cross bar to its rest position. In strong winds or when it is otherwise desired to increase the amount of such predetermined tension upon the lines 98 and 99, a control line 110 is additionally attached to the ring 104 and passes outwardly of the mast 26 through an opening 112 provided for such purpose. The other end of the control line 110 can be fixed to a cleat or other attachment device (not shown) on the mast, and in such manner the amount of slack and or tension in either line can be selectively limited to the extent desired.

Figure 17:
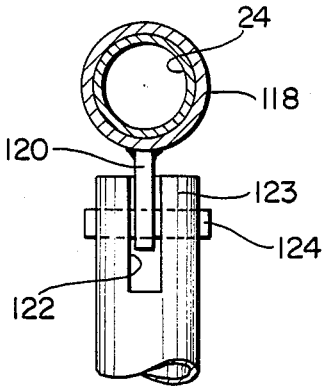
FIG. 17 is a cross-sectional view along the line 17—17 of FIG. 15.
Figure 16:
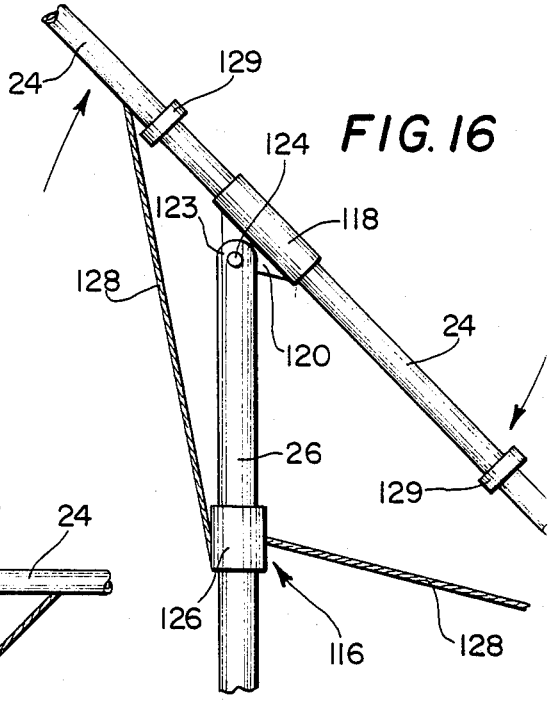
FIG. 16 is a view similar to FIG. 15 but showing the supporting cross bar of the foil laterally displaced with regard to FIG. 15.
Figure 15:
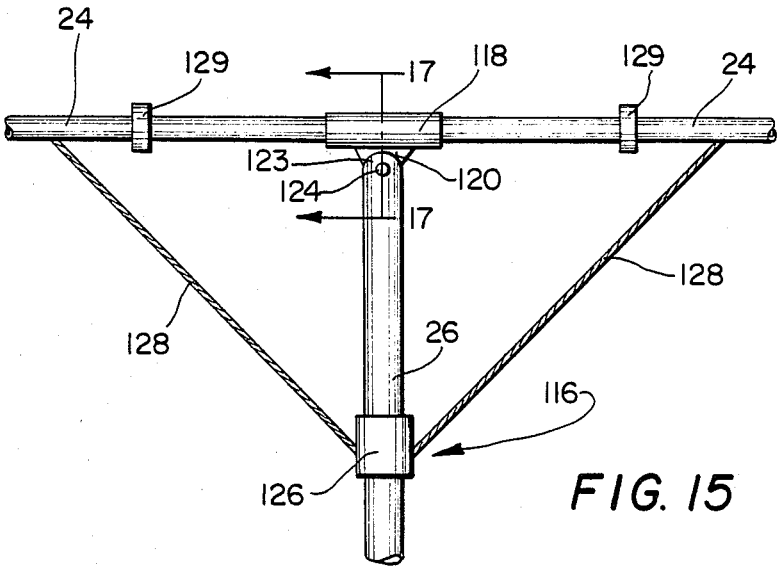
FIG. 15 shows another structural form in which the self-leveling system for the foil may take.
Figure 18:
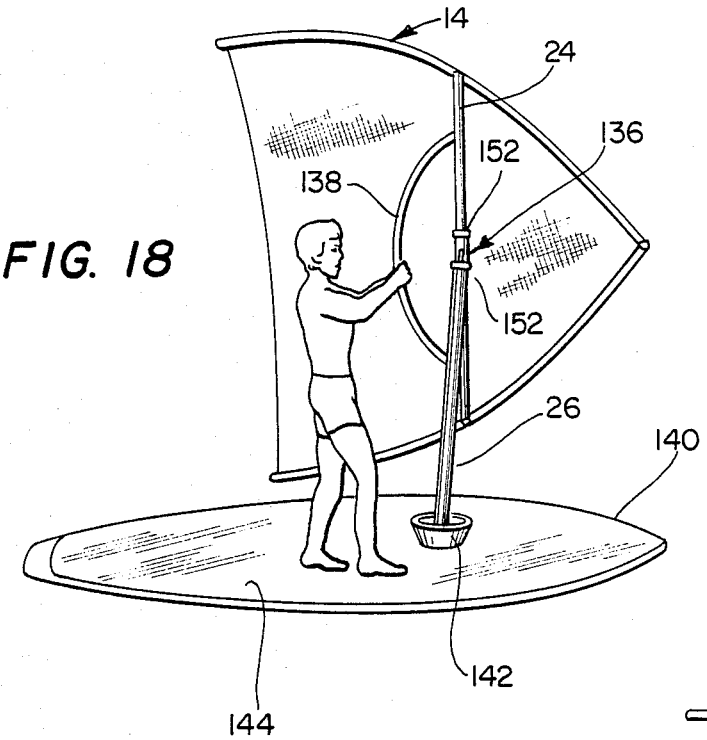
FIG. 18 is a perspective view showing a modified fluid foil system particularly adapted for use with a sailboard and shown mounted in conjunction therewith.

Referring now to FIGS. 15 through 17, an alternate form of tilt limiting mechanism 116 is depicted Therein the cross bar 24 is slidably supported within a sleeve 118, in turn pivotally fixed to the mast 26. In this regard, the sleeve 118 includes a downwardly extending tab 120 having an opening provided therethrough and adapted to fit within an open-ended slot 122 provided in the bifurcated end of the mast 26. A pin 124 extends through openings provided in the bifurcated end as well as through the opening provided in the tab 120. It may thus be apparent that the cross bar 24 is supported on the mast 26 for pivotal or torsional movement as in some of the previously described embodiments. A hollow sleeve 126 is supported by the mast 26 and is slidably adjustable to a variety of fixed positions therealong. Lines 128 of equal fixed length are attached at opposite ends respectively to the sleeve 126 and to the cross bar 24. In this manner as the cross bar is subject to an outside constraint so as to, for example, tilt it downwardly to the right as shown in FIG. 16, the cross bar 24 is then forced by the length of the then uppermost line (the left line as shown in FIG. 16) to slide downwardly to the right relative to the tube 118 until it reaches a point where one of the lines 128 is taut or the sleeve 118 contacts some limiting means such as the collars 129 shown. This displacement of the foil area towards whichever side is tilted downward gives this side aerodynamic lift over the other resulting in added leveling tendency which is especially helpful when wind strength increases. This, in effect, provides automatic aerodynamic leveling to counteract increased heeling force on the foil supporting body.

Turning now to FIGS. 18 through 21 of the drawings, a still further alternate form of a self-leveling system 136 is depicted. Such system has particular utility with lighter rigs such as may be fashioned for use with a hand supported and manipulated foil, i.e., for use with sailboards or wind surfers and the like, although not limited to such use. In such system, a foil 14, as utilized in the previous embodiments and including a cross bar 24, may be utilized. Instead of control sheets 40, however, the foil 14 is manipulated by a hand-held generally U-shaped bar 138 which is fixedly connected to the cross bar 24 at intermediate locations on opposite sides of its connection to the mast 26. The mast 26 is in turn generally supported in a somewhat forward position in the sailboard 140 by means of a cowl 142 preferably of inverted conical shape and permitting the mast 26 to angularly tilt with regard to the upper surface 144 of the sailboard. The mast 26 may be stepped into the cowl 142 in any acceptable manner and, accordingly, able to assume a tilt within the limits of the sidewalls of the cowl 142 in a full 360° path. The sailboard 140 is also conventionally provided with a centerboard 146 and a stabilizing fixed rudder 148. Also, although a limited vertical tilt of the mast with respect to the sailboard in a full 360° circle is desirable for full flexibility, advantages can be obtained by utilizing a more limited degree of tilt facility; thus, the cowl 142 may assume the configuration of a longitudinally elongated slot of a width just slightly greater than the mast such that only forward and reverse tilt is permitted.

Figure 21:
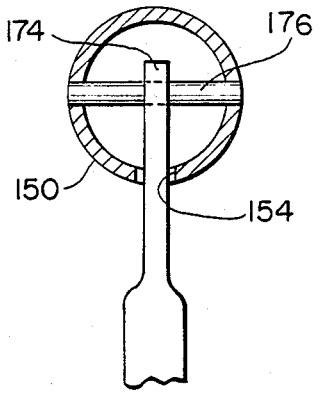
FIG. 21 is a detail elevational view showing the manner in which the rod shown in FIG. 20 is connected to the cross bar sleeve.
Figure 19:
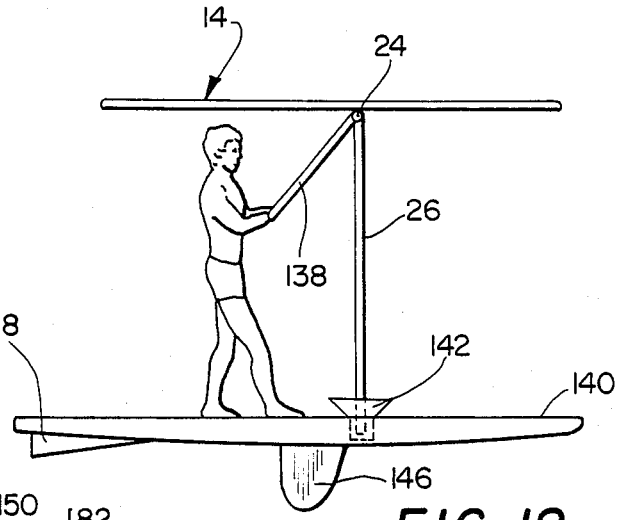
FIG. 19 is a side elevational view of the sailboard and fluid foil system shown in FIG. 18 but disposed in its rest position with respect to wind currents generally assumed to be parallel with the surface of the water.
Figure 20:
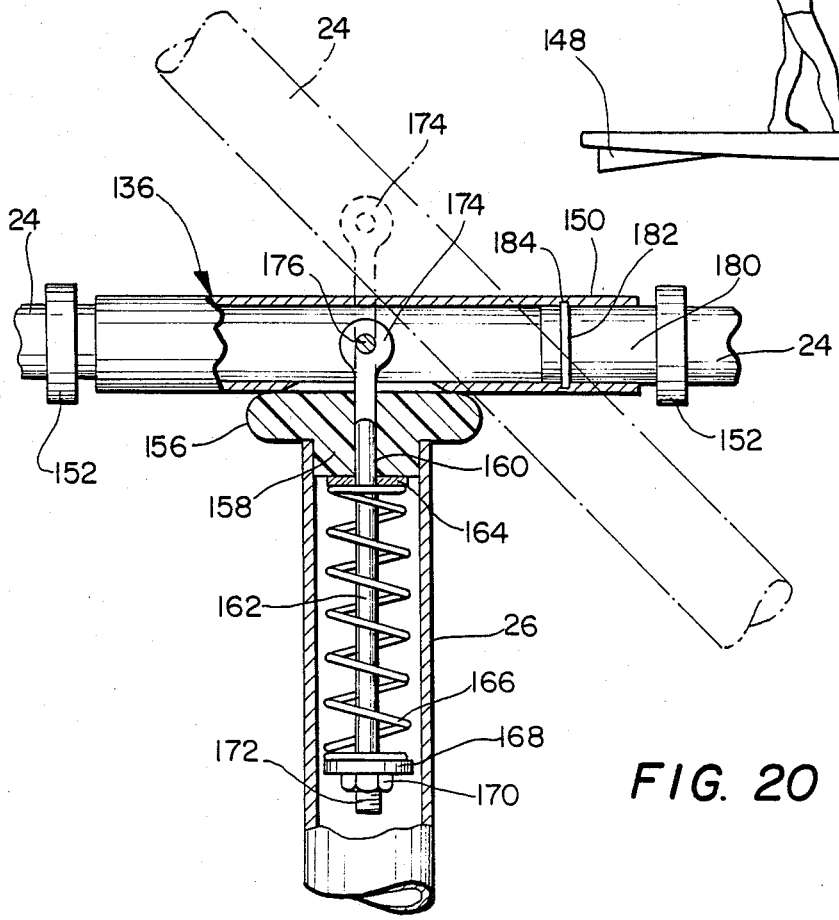
FIG. 20 is an enlarged partially sectioned elevational view showing the manner which the fluid foil is connected to the mast.

The manner in which the cross bar 24 is connected to the mast 26 in the self-leveling system 136 under consideration is best shown by reference to FIGS. 20 and 21 of the drawings. Therein the cross bar 24 is rotationally supported within a sleeve 150 and additionally slidable therein within the limits defined by the collars 152 fixedly connected to the cross bar 24 at locations slightly spaced from the ends of the sleeve 150 in order that some lateral play of the cross bar 24 with respect to the sleeve 150 is afforded for a purpose which will hereinafter be apparent. In addition, the bottom of the sleeve 150 is provided with an elongated open slot 154 which in turn is adapted to rest upon the upper surface of a plug 156 which includes a downwardly extending boss portion which fits into the upper open end of the tubular mast 26. The plug 156 includes a central bore 160 in which a rod 162 is positioned for vertical slidable movement with respect thereto. The lower surface of the plug boss 158 is provided with a washer 164 against which the upper end of a spring 166 abuts. The lower end of the spring similarly contacts a washer 168 adjustably held in a fixed position relative to the rod 162 by means of a nut 170 threaded on the threaded lower terminal end 172 of the rod 162. Inasmuch as the plug 156 is fixed in relationship to the mast 26, the force of the spring 166 continually urges the rod 162 downwardly into the open upper end of the mast 26. The upper end of the rod 162 terminates in an eyelet 174 through which a pin 176 extends through the sleeve 150 so as to position the upper end of the rod within the hollow interior of the sleeve 150. From such description it may be apparent that the cross bar and, accordingly, the foil 14 is held in position on top of the mast 26 by the action of the spring 166 and thus is continually urged to the position shown in the full lines in FIG. 20 by such spring action. Such attitude is the rest or level position previously referred to and is the position which is continually sought by the action of the spring when free from other constraints.

The foil 14, however, may be manipulated in a number of directional attitudes vis-a-vis the mast 26 either by the effect of wind upon the foil or by manipulation of the control bar 138 by the rider or a combination of both. It, accordingly, will be apparent that the cross bar 24 can be tilted to assume the position shown by the dotted lines in FIG. 20 or any intermediate position by force application thereupon by the control bar 138. When such is accomplished, the lower end of the sleeve 150 contacts the rounded plug surface 156; and at the same time, the rod 162 is vertically extended upwardly so as to compress the spring 166. In that regard, the outer ends of the sleeve 150 are slightly spaced from the collars 152 such that such tilting action does not cause interference contact between the outer ends of the sleeve and the collars 152. This tilting action may assume various angular displacements and in a full rotational directional, that is, the foil 14 is free to rotate with respect to the mast 26 at the upper end thereof by frictional contact on the plug 156 when such rotational force is brought about either by manipulation of the control bar 138 or by wind force application to the foil 14 or any combination thereof. In addition, it is also possible to change the front to rear attitude of the foil 14 with respect to the sailboard by application of a swinging or arcuate movement to the control bar 138 with respect to the main planar configuration of the foil 14. This action imparts a rotational movement of the cross bar 24 with respect to the sleeve 150 and enables the surfboarder to quickly manipulate the foil surface 14 in an up and down movement as may be desirable in riding the crest of waves and the like. In this regard, it should be pointed out that the cross bar 24 does not extend entirely through the sleeve 150 but comprises of stubs 180 secured to the inside surface of the sleeve 150 by conventional means such as the inclusion of an expandable ring 182 adapted to extend into a circular seat 184 formed in the inside surface of the sleeve. Other conventional means may be utilized, however, to insure the connection of the stub ends of the cross bar 24 in the sleeve 150.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A fluid foil system for imparting energy from a moving fluid medium to a supporting body which body in turn is supported by means other than said moving fluid medium, said system including a fluid foil connected to a mast along a longitudinal axis thereof, said foil supported for free multi-rotational movement with respect to said body, said foil further adapted for lateral tilt in either direction with respect to said mast about said longitudinal axis from a "level" rest position where said foil is generally aligned with the directional flow of said fluid medium to a tilted position wherein said fluid imparts energy to said foil, and structural self-leveling means for said foil connected to both said foil and said mast and adapted to continually urge said foil to said rest position, including means for positively moving said foil to a tilted position and constraining said foil in said tilted position, said self-leveling means separate from said means for positively moving said foil to a tilted position, and wherein said means for positively moving said foil overcomes the urging force of said self-leveling means during movement to said tilted position.

2. The fluid foil system of claim 1 wherein said self-leveling means is adapted to automatically return said foil to its rest position when free from other constraints.

3. The fluid foil system of claim 2, said foil including a supporting cross bar pivotally connected to said mast, said self-leveling means including a pair of lines fixedly connected at one end thereof to said cross bar and portions thereof on either side of said connection and extending into said mast where other ends thereof are connected to spring means mounted in said mast.

4. The fluid foil system of claim 3, the tension of said spring means being adjustably fixed.

5. The fluid foil system of claim 1 wherein said mast is supported by said body for multi-rotational movement with respect thereto at a point spaced from said foil connection thereto.

6. The fluid foil system of claim 1 wherein the longitudinal attitude of said foil in its rest position is fixed in said position generally aligned to the flow direction of said fluid medium.

7. The fluid foil system of claim 1 wherein said foil is generally disposed at its gravity balance center with respect to said mast.

8. The fluid foil system of claim 1 wherein said self-leveling means includes a spring for automatically returning said foil to its rest position when free from other constraints.

9. The fluid foil system of claim 1 whereupon when the foil is tilted to a power position the mast automatically freely rotates to a position where the foil is positioned oblique to the compass direction of the moving fluid medium.

10. The fluid foil system of claim 9 wherein said oblique position of the foil is generally normal to said compass direction of the moving fluid medium.

11. A fluid foil system for imparting energy from a moving fluid medium to a supporting body which body in turn is supported by means other than said moving fluid medium, said system including a fluid foil connected to a mast along a longitudinal axis thereof, said foil supported for free multi-rotational movement with respect to said body, said foil further adapted for lateral tilt in either direction with respect to said mast about said longitudinal axis from a "level" rest position where said foil is generally aligned with the directional flow of said fluid medium to a tilted position wherein said fluid imparts energy to said foil, and self-leveling means for said foil connected to both said foil and said mast and adapted to urge said foil to said rest position, wherein said self-leveling means is adapted to automatically return said foil to its rest position when free from other constraints, said foil including a supporting cross bar pivotally connected to said mast, said self-leveling means including a pair of lines fixedly connected at one end thereof to said cross bar and portions thereof on either side of said connection and extending into said mast where other ends thereof are connected to spring means mounted in said mast.

12. The fluid foil system of claim 11, the tension of said spring means being adjustably fixed.

13. A fluid foil system for imparting power from a moving fluid medium to a supporting body which body in turn is supported by means other than said moving fluid medium, said system including a generally laterally symmetrical fluid foil connected to a mast along a longitudinal axis thereof, said mast supported for free, unlimited rotational movement with respect to said body, said foil further adapted for major lateral tilt in either direction with respect to said mast about said longitudinal axis from a fluid power-off or "level" rest position where said foil is generally aligned with the directional flow of said fluid medium to a tilted position wherein said fluid imparts power to said foil, operational control means for moving said foil to various tilt attitudes and separate self-leveling means for continually urging said foil to said rest position connected to both said foil and said mast and adapted to automatically return said foil to said rest position when free from said operation control means.

14. The fluid foil system of claim 13, said foil including a supporting cross bar pivotally connected to said mast, said self-leveling means including a pair of lines fixedly connected at one end thereof to said cross bar and portions thereof on either side of said connection and extending into said mast where other ends thereof are connected to spring means mounted in said mast.

15. The fluid foil system of claim 14, the tension of said spring means being adjustably fixed.

16. The fluid foil system of claim 13, said operational control means being a single sheet attached at opposite ends to laterally opposed sides of said foil.

17. The fluid foil system of claim 13 whereupon when the foil is tilted to a power position the mast automatically freely rotates to a position where the foil is positioned oblique to the compass direction of the moving fluid medium.

18. The fluid foil system of claim 17 wherein said oblique position of the foil is generally normal to said compass direction of the moving fluid medium.

* * * * *